US008336141B2

(12) United States Patent
Wong

(10) Patent No.: US 8,336,141 B2
(45) Date of Patent: Dec. 25, 2012

(54) RESCUING AND CARRYING DEVICE

(76) Inventor: Cho Kee Wong, Kowloon (HK)

( * ) Notice: Subject to any disclaimer, the term of this patent is extended or adjusted under 35 U.S.C. 154(b) by 0 days.

(21) Appl. No.: 12/438,546

(22) PCT Filed: May 10, 2007

(86) PCT No.: PCT/CN2007/001525

§ 371 (c)(1),
(2), (4) Date: Feb. 23, 2009

(87) PCT Pub. No.: WO2008/025203

PCT Pub. Date: Mar. 6, 2008

(65) Prior Publication Data

US 2009/0313759 A1 Dec. 24, 2009

(30) Foreign Application Priority Data

Aug. 24, 2006 (CN) ..... 2006 2 0132715 U

(51) Int. Cl.

| | |
|---|---|
| ***A47B 1/00*** | (2006.01) |
| *A45F 3/14* | (2006.01) |
| *A61G 1/00* | (2006.01) |
| *A61G 5/00* | (2006.01) |
| *A45G 3/04* | (2006.01) |

(52) U.S. Cl. ..... 5/627; 5/625; 5/626; 5/628; 224/157; 224/184; 224/259

(58) Field of Classification Search ..... 5/627, 625, 5/626, 628; 224/157, 184, 259
See application file for complete search history.

(56) References Cited

U.S. PATENT DOCUMENTS

| | | | | |
|---|---|---|---|---|
| 1,096,489 | A * | 5/1914 | Chadwick | 224/157 |
| 2,788,530 | A * | 4/1957 | Ferguson | 5/628 |
| 4,978,044 | A * | 12/1990 | Silver | 224/601 |
| 5,014,374 | A * | 5/1991 | Williams | 5/628 |
| 6,196,229 | B1 * | 3/2001 | Piazza | 128/869 |

FOREIGN PATENT DOCUMENTS

| | | | |
|---|---|---|---|
| CN | 2547302 | Y | 4/2003 |
| CN | 2552520 | Y | 5/2003 |
| CN | 1457752 | A | 11/2003 |

OTHER PUBLICATIONS

WIPO, International Search Report for International Application No. PCT/CN2007/001525, with English translation.
WIPO, English version of International Preliminary Report on Patentability.

* cited by examiner

*Primary Examiner* — Jonathan Liu
(74) *Attorney, Agent, or Firm* — Intellectual Property Law Group LLP

(57) ABSTRACT

A rescuing and carrying device comprising a supporting portion, handhold belts, safety belts and shoulder belts, each made of flexible materials. The handhold belts, safety belts and shoulder belts are fixed on the supporting portion respectively. The device comprises lightweight, flexible and foldable materials. With the shoulder belts, the device can be lifted or carried on the shoulders of carriers, allowing for hands-free operation by the carrier.

10 Claims, 6 Drawing Sheets

RESCUING AND CARRYING DEVICE

FIELD OF THE INVENTION

The invention relates to a rescuing and carrying device, more specifically, to a stretcher-type rescuing and carrying device.

BACKGROUND OF THE INVENTION

Rescuing and carrying devices are commonly used for rescuing the sick. It has been shown that these devices have greatly improved rescuing. Among these devices, the stretcher-type rescuing and carrying device plays an important role. A traditional stretcher-type rescuing and carrying device generally refers to a stretcher, comprising a frame and a supporting surface made of flexible and strong material, such as canvas. With improved living standards and medical technology, the traditional stretcher has become more advanced and increasingly integrated with other medical technology. Take for example, in the stretcher disclosed in Chinese patent CN1457752A there are necessary first-aid devices and appliances, and a power supplier embedded within, which can stabilize the seriously wounded on location and protect them during carrying. However, with the stretcher increasingly integrated, the volume, weight and cost have increased accordingly, which may make the rescue and carry device more difficult to carry, inconvenient to use on the battlefield or out in the county, and difficult for a resident to store.

Chinese patent 2547302Y discloses a rotary foldable stretcher, which can be folded into a smaller one for use in daily life and battle. However, this stretcher also has some parts such as a handle, a stretcher rod, a transverse support, a surface of rescuing and carrying, belts for fastening the sick, and hinges etc., thus its structure is complicated and the cost is high. Besides, with stiff materials such as the supporting rod, this stretcher may be difficult to fold, and inconvenient to store.

Chinese patent CN2552520Y discloses another stretcher for medical use which comprises a left bar, a right bar and several belts in parallel. However, the defects mentioned above haven't been thoroughly overcome yet since some stiff materials, such as the bars, are still included in the stretcher.

When carrying the stretcher mentioned above, at least two people are needed, so it cannot be used under emergency situations when one's hands are occupied. This kind of carrying method may slow down the carrying speed.

BRIEF SUMMARY OF THE INVENTION

With regard to the above technical problem, the invention is directed to provide a stretcher-type rescuing and carrying device with simple structure and low cost, which is not only light, portable, and requires less manpower, but can be used to carry the sick laying down and sitting up.

For the above objective, the invention provides a rescuing and carrying device, comprising: a supporting portion made of flexible materials; handhold belts made of flexible materials, which are fixed on said supporting portion; safety belts made of flexible materials, which are fixed on said supporting portion; and shoulder belts made of flexible materials, which are fixed on said supporting portion. Being made of flexible materials, the device is light, has reduced carrying weight, and can be folded up. Additionally, it can be stored and used on the battlefield or at home. The rescuing and carrying device can be stored under the mattress when not in use, and can be used as a rescuing tool in the event of emergency by fastening the safety belt. It is especially suitable for the battle field or countryside hospitals and clinics. Using the shoulder belts, the present rescuing and carrying device can be lifted or carried on the shoulders of the carriers. It reduces the possibility of hurting the carrier's waist, backbone, and hands, which results from operating a device with only the hands. The shoulder belts free the carriers' hands to deal with other urgencies.

According to the rescuing and carrying device of the invention, the supporting portion has a sheet or bag shape, such that either shape of the supporting portion can be provided.

According to the rescuing and carrying device of the invention, there are at least two pairs of handhold belts, each pair is spaced a certain distance from the other and fixed on the side borders of the supporting portion. There is a hand liner on the handhold belt, and its position can be adjusted. In this way, the rescuing and carrying device can be lifted by more people by using the handhold belts for rescuing like other stretchers. Additionally, the rescuing and carrying device can be transformed to the traditional stretcher by inserting a hard rod into the handhold belt.

According to the rescuing and carrying device of the invention, the safety belts optionally comprise shoulder safety belts, chest safety belts, waist safety belts and leg safety belts. In this way, the corresponding part of the sick can be fixed on the device, preventing the sick from accidentally falling off the device or bumped around due to rough roads, which could aggravate an existing injury or cause a new one.

According to the rescuing and carrying device of the invention, one end of the shoulder safety belt is fixed on the supporting portion, and the other end is adjustably connected to the waist safety belt. The upper body of the sick can be fixed stably. In addition, there are two leg safety belts fixed to the waist safety belt so that the sick can sit while being rescued. In this way, the sitting position of the sick is stable and the two legs are stabilized.

According to the rescuing and carrying device of the invention, there is one pair of shoulder belts respectively fixed on both sides of the supporting portion, with one end mounted to the top border of the supporting portion and the other end mounted below the midpoint of the side border.

Using the shoulder belts, the present rescuing and carrying device can be lifted or carried on the shoulders of the carriers. The shoulder belts reduce the possibility of hurting the carriers' waists, backbones and hands, which can result from operating the device only with the hands. The shoulder belts can free the carriers' hands to deal with other emergency events. This structure makes it convenient to carry an unconscious person, and allows the carrier to balance the device despite any imbalance from the weight of the unconscious body. Moreover, carrying the sick from two sides can stabilize the device and reduce any negative effects from the carry speed.

According to the rescuing and carrying device of the invention, there are adjustable shoulder gaskets on the shoulder belts. By using this structure, the comfort of the carriers' back can be increased and the possibility of injuring the carrier's shoulder can be reduced.

According to the rescuing and carrying device of the invention, there is a length adjustable member on the shoulder belt. Carriers can adjust the length of the belts according to the height of the sick, and can adjust it freely even while carrying someone without offloading the person. This eliminates any unnecessary injury to them and gets them to the ambulance as soon as possible.

According to the rescuing and carrying device of the invention, the rescuing and carrying device also includes a drag belt made of flexible materials, which is fixed on the supporting portion. With this structure, the rescuing and carrying device can be dragged by a single carrier, so the device can be used when there is no one else around. This is especially useful when people are escaping and need to escape the disaster field immediately with a limited number of carriers.

According to the rescuing and carrying device of the invention, the two ends of the drag belt are fixed on the upper side or lower side of the supporting portion so that the carriers can drag the device in different directions.

According to the rescuing and carrying device of the invention, the device also comprises a protection cover, which is connected to the supporting portion and forms a protection sheath. In addition, a slide fastener is arranged on the protection cover to open the sheath, so it is suitable for carrying a corpse. Being relatively airtight, it can reduce the effusion of body odor and prevent liquid from flowing out of the device. Furthermore, the material and process required for wrapping a corpse can be saved, and the carrying weight can be decreased.

According to the rescuing and carrying device of the invention, a window is arranged on the protection sheath, so that the identity of the decedent can be recognized without opening the protection sheath.

According to the rescuing and carrying device of the invention, the safety belts are set in the inner part formed by the protection cover and the supporting portion. In this way, the corpse can be fixed in the protection sheath formed by the supporting portion and the protection cover.

According to the rescuing and carrying device of the invention, the length of the protection cover can be shorter than that of the supporting portion, and the bottom border and side borders of the cover are connected to those of the supporting portion. There is an opening between the top borders of the cover and the supporting portion. In this way, the supporting portion together with the protection cover can form a body protection sheath. By putting the body of the sick into the cover, quick loss of body heat can be avoided. With the protection sheath, there is no need to bring blankets to the sick. In the rescuing and carrying device, the supporting portion is rectangular. Thus, it is conveniently manufactured.

According to the rescuing and carrying device of the invention, the shape of the supporting portion corresponds to the shape of the back and legs of a person. In addition, the device also comprises a back supporting portion, and a leg supporting portion on which leg fastener belts made of flexible materials are placed. With this structure, one person can carry the sick. Therefore, it is very useful during emergency and when there are limited rescuers.

According to the rescuing and carrying device of the invention, the shoulder belts further comprise a shoulder fastener belt and a waist fastener belt, which are set on the supporting portion. With this structure, the carrier can carry the sick on his back stably. The carrier and the sick are back to back. The two hands of the carrier can then deal with every event without any limitation. Meanwhile, the sick who face backward can watch the surroundings and his hands can deal with every event without any limitation. The device is especially suitable for carrying someone who is partially hurt, conscious, and can still fight with their hands while the battle is taking place.

According to the rescuing and carrying device of the invention, the safety belts comprise shoulder safety belts, waist safety belts and leg safety belts, wherein the shoulder safety belts and waist safety belt can be used as shoulder fastener belts and waist fastener belts at the same time. With this structure, the carrier can carry the sick on his back stably and his hands can deal with the emergency.

According to the rescuing and carrying device of the invention, the flexible materials are non-woven fabric. With this feature, the device is waterproof, mildew-proof and ventilated.

DETAILED DESCRIPTION OF THE DRAWINGS

The preferred embodiments of the present invention will be described in detail with reference to the accompanying drawings.

Figure 1:
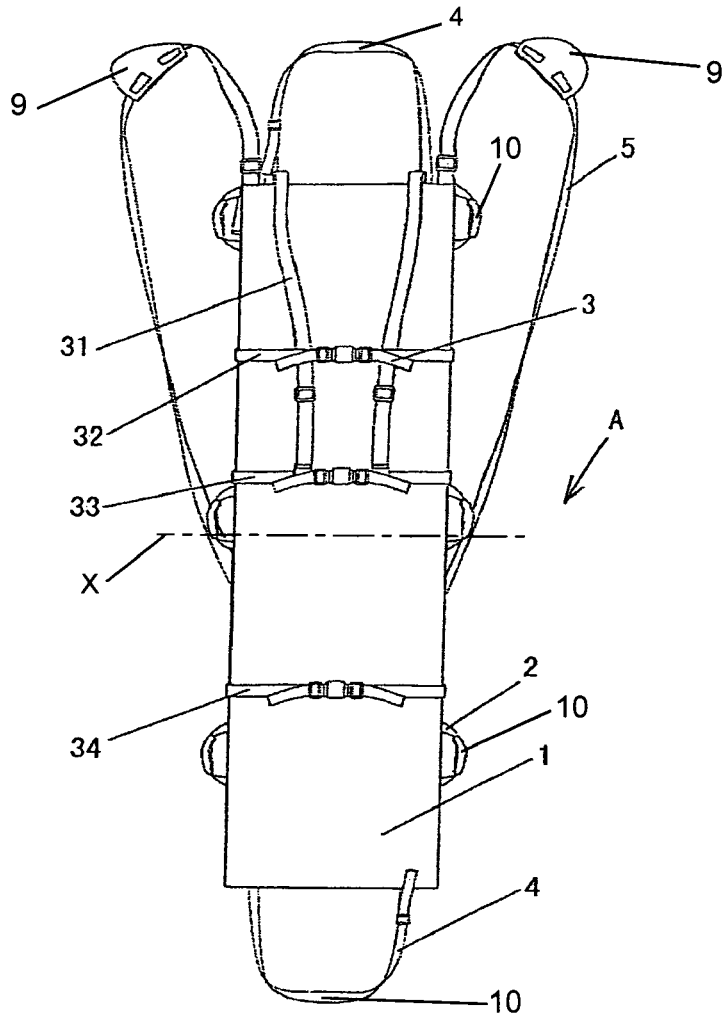
FIG. 1 is a front view illustrating a rescuing and carrying device in accordance with the first embodiment of the present invention.
Figure 2:
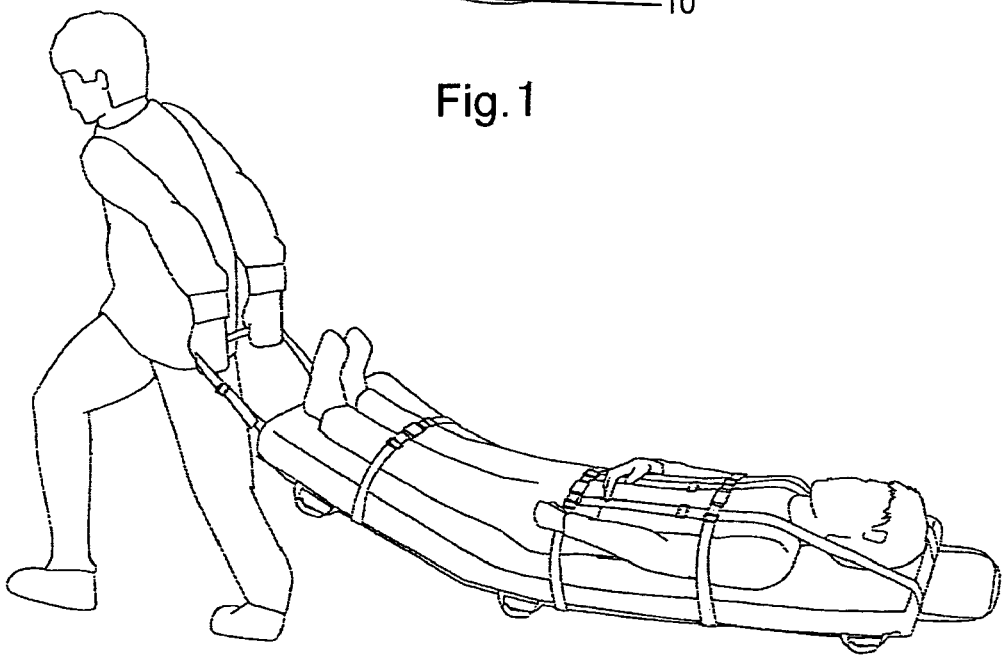
FIG. 2 is a state diagram illustrating a rescuing and carrying device in use in accordance with the first embodiment of the present invention.

See FIG. 1 and FIG. 2, in which a rescuing and carrying device in accordance with the first embodiment of the present invention is shown. The rescuing and carrying device A of the embodiment comprises: a supporting portion 1, handhold belts 2, safety belts 3, drag belts 4, and shoulder belts 5, which are fixed on the supporting portion 1.

The supporting portion 1 has a rectangular shape, and includes a top border, a bottom border, and two side borders. The length of the supporting portion is somewhat longer than the height of the ordinary person and the width is somewhat wider than that of an ordinary person. The supporting portion can be made into a single sheet or a bag. The single sheet can be designed as a single layer of thin fabric, or alternatively, flexible materials with certain thickness can be chosen to enhance the comfort of the supporting portion. The selection of materials depends upon the practical application.

Herein, there are three pairs of handhold belts 2, with each pair fixed on the upper end, middle part, and lower end of the supporting portion's two side borders. There is a hand liner 10 on the handhold belt 2, and its position can be adjusted.

The safety belt 3 comprise two shoulder safety belts 31, a chest safety belt 32, a waist safety belt 33 and a leg safety belt 34, on each of which an adjusting member is arranged to enable length adjustment. The upper ends of the two shoulder safety belts are fixed on the top border of the supporting portion 1 respectively, the lower ends of the two shoulder safety belts respectively go through the chest safety belt and are fixed on the waist safety belt 33, thereby the fixed position of a sick person is adjustable. The chest safety belt 32, the waist safety belt 33 and the leg safety belt 34 all have buckles which can be unbuckled and buckled. Here, the safety belts 3 cooperate to fasten the sick on the rescuing and carrying device.

The device, according to an embodiment, is designed to have two drag belts 4, with each fixed respectively on the top border and the bottom border of the supporting portion 1. In addition, adjusting members are also placed on the drag belts to adjust the length depending upon the need. The two ends of the drag belt 4 are respectively fixed at different positions of the corresponding border. There are hand liners 10 on the drag belt with adjustable positions.

The device is designed to have two shoulder belts 5, with each arranged on the two side borders of the supporting portion 1. The upper end of the belt is fixed on the end of the top border, and the lower end is fixed below the midpoint of the side border (shown as X), which corresponds to the lower part of the leg of the sick. Moreover, the length adjusting members and the shoulder gasket 9 are arranged on the shoulder belts 5.

Each of the above components is made of flexible materials, which have certain tenacity.

When using the device, unbuckle each safety belt 3 and put the sick horizontally on the supporting portion 1; then buckle all the safety belts 3 to stabilize the sick on the supporting portion 1; two carriers then put the shoulder belts 5 on their shoulder to carry the sick. Alternatively, two or more carriers can carry the device using the handhold belts 2 and/or drag belts 4. When the hands are not strong enough, the drag belts 4 can also be used by one carrier to lift, and then the carrier can decide to draw the head part drag belt or the leg part drag belt 4 according to the situation at that time.

The rescuing and carrying device A of the present embodiment has the following advantages:

1. With the supporting portion made of flexible materials, the rescuing and carrying device can be stored under the mattress, and in an emergency, the device can be used as rescuing equipment by just fastening the belt.

2. With the handhold belts, the device can be carried by more carriers through lifting by the handhold belts if enough carriers are available.

3. With the safety belt, the sick can be fastened stably on the device so as to prevent the sick from falling out of the device accidentally or due to a rough road when carrying. This prevents needless injury.

4. With the drag belts, the device can be towed by one carrier when there are not enough carriers.

5. Because the device has shoulder belts, the carrier can carry the belts on the shoulders and simultaneously the arms can lift the handhold belts. In this way, it can significantly reduce the possibility of hurting the carriers' waists, backbones and hands, which can result from operating the device using only the hands. This frees the carrier's hands to deal with other emergency events. Through using the structure, it is very convenient to carry the unconscious, and the device can be balanced by the carrier by avoiding the weight imbalance of the unconscious body. The shoulder gasket can enhance the comfort of carrying. Moreover, the length adjustable member on the shoulder belt can be adjusted to make the length of the belts match the height of the sick, and it can be adjusted freely even while carrying the sick without having to unload them. This eliminates unnecessary injury and gets them to the ambulance as soon as possible.

The present embodiment is suitable for use in hospitals or clinics, especially battlefield hospitals, clinics, field aid stations, etc., where people are escaping and evacuating from the disaster field with limited carriers as soon as possible.

The second embodiment of the invention will be described as follows.

Figure 3:
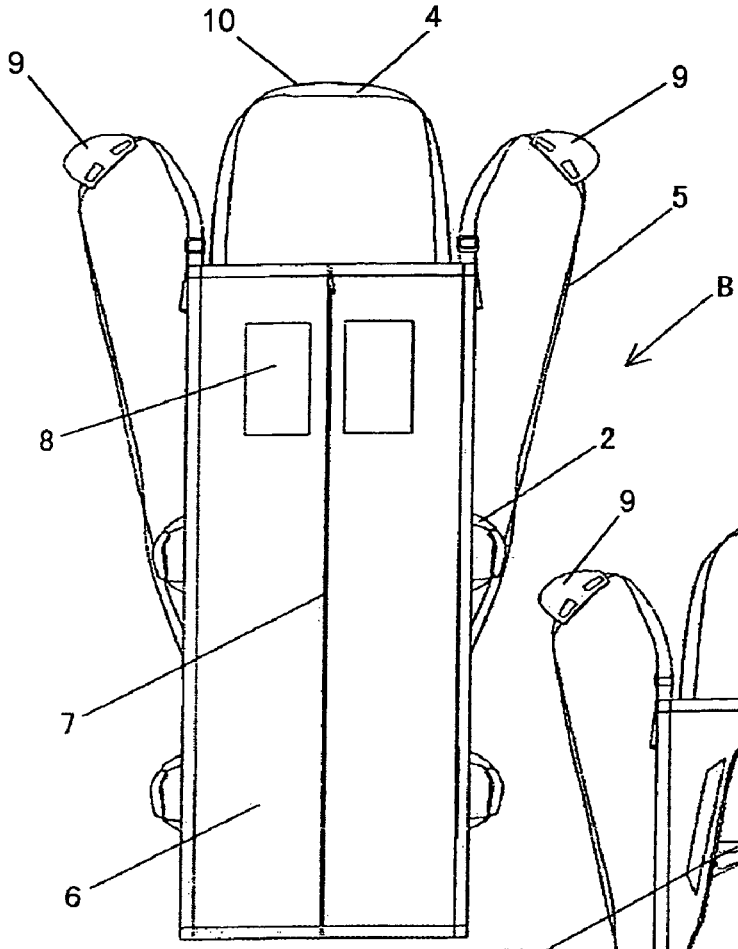
FIG. 3 is a front view illustrating a rescuing and carrying device in accordance with the second embodiment of the present invention.
Figure 4:
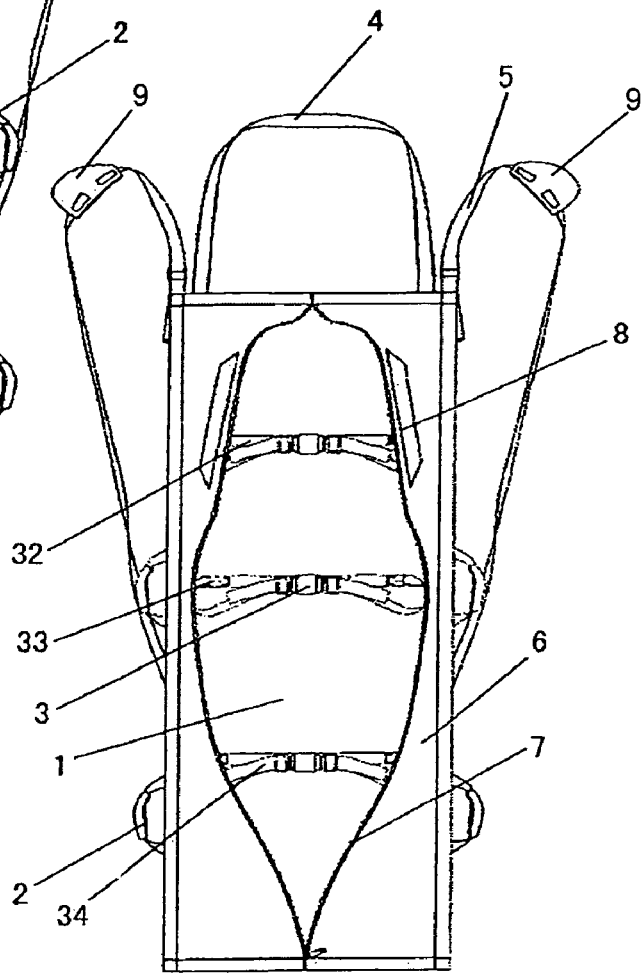
FIG. 4 is a front view illustrating a rescuing and carrying device with the slide fastener open in accordance with the first embodiment of the present invention.

FIG. 3 and FIG. 4 illustrate a rescuing and carrying device in accordance with the second embodiment of the present invention. The rescuing and carrying device B of the present embodiment comprises: a supporting portion 1, handhold belts 2, safety belts 3, drag belts 4 and shoulder belts 5, which are fixed to the supporting portion 1.

Here, the structure of the supporting portion 1 is the same as that of the first embodiment.

There are two pairs of handhold belts 2 fixed in pairs on the middle part and lower end of the supporting portion's two side borders. A hand liner 10, the position of which can be adjusted, is placed on the handhold belt 2.

The safety belts 3 comprise a chest safety belt 32, a waist safety belt 33 and a leg safety belt 34. The structure is respectively the same as that of the first embodiment. The upper ends of the two shoulder safety belts are fixed on the top border of the supporting portion 1.

Here, the device is designed to have one drag belt 4, on which the adjusting members are arranged for changing the length, dependent upon need. The two ends of the drag belts 4 are fixed respectively on the two ends of the shorter border of the supporting portion 1. Alternatively, there is a hand liner 10, the position of which can be adjusted, arranged on the drag belt 4.

Here, the shoulder belts 5 are the same as those of the first embodiment.

The rescuing and carrying device B of the embodiment also includes a protection cover 6, the length and width are equal to or somewhat larger than those of the supporting portion 1. The four borders of the protection cover are connected to those of the supporting portion to form a close protection sheath. There is also a slide fastener 7, the length is the same as that of the protection cover arranged on the middle of the protection cover 6 for opening the sheath. On both sides of the slide fastener 7, there are two windows 8, covered by transparent materials or ventilate silk, for recognizing the decedent's identity without opening the protection sheath.

Each of the above components is made of flexible materials with certain tenacity. When using the device, unbuckle the safety belt 3 and put the sick horizontally on the supporting portion 1; then buckle the safety belts 3 to make the sick be fixed stably on the supporting portion 1; and then the sick is enclosed within the protection sheath by sliding the slide fastener up; the carrier can put the shoulder belts 5 on the shoulder and hold the handhold belts 3, depending on the needs for lifting the sick. Where the sick needs to be carried away lying down, the shoulder belts 5 need not be used, and only the drag belt 4 and the handhold belts 2 are used for carrying. Where there are not enough carriers during an emergency, the drag belts 4 can be used by one carrier to carry.

The rescuing and carrying device B according to the embodiment further has the following advantages besides those of the first embodiment:

1. The safety belts inside the protection sheath can fix the decedent stably, and prevents shaking of the device during carrying allowing the carriers to maintain their carrying speed.

2. The decedent's identity can be recognized through the transparent window directly without opening the protection sheath.

3. The structure is especially suitable for carrying corpses. Being relatively airtight, it can reduce the effusion of body odor and prevent liquid from flowing out of the device. Furthermore, the material and process required for wrapping the corpse can be saved, and the carrying weight can be decreased. The safety belts can fix the corpse and balance the weight on the device to make the carrying easy. The transparent windows are convenient for identifying the corpse.

The third embodiment of the invention will be described as follows.

Figure 5:
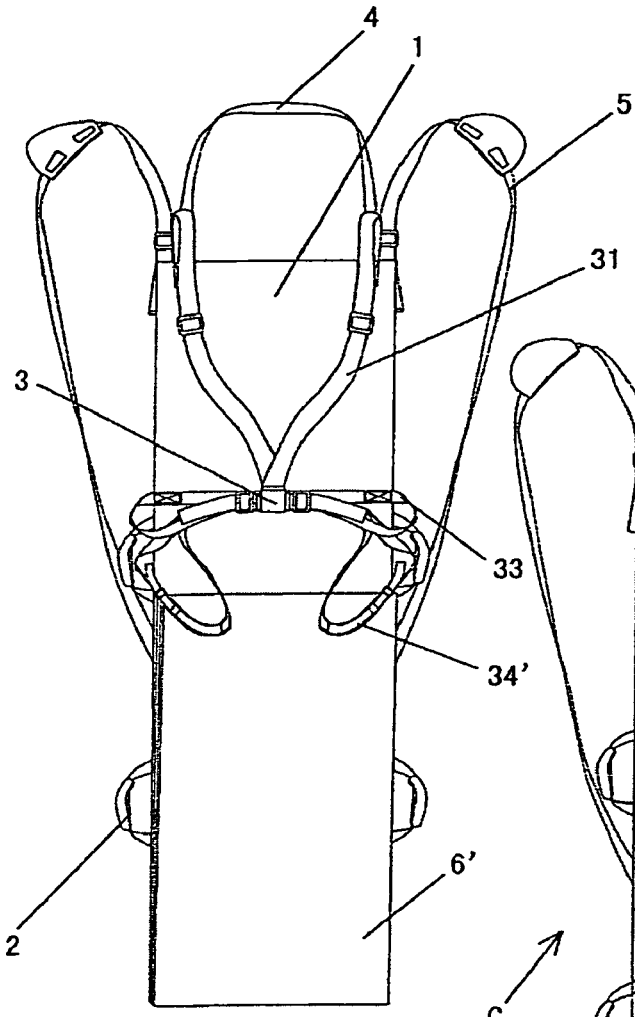
FIG. 5 is a front view illustrating a rescuing and carrying device in accordance with the third embodiment of the present invention.
Figure 6:
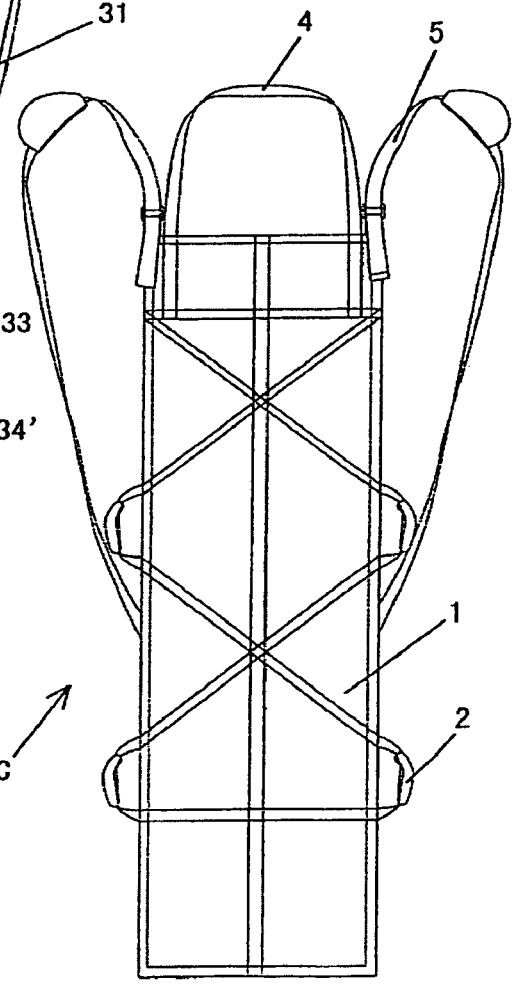
FIG. 6 is a back view illustrating a rescuing and carrying device in accordance with the third embodiment of the present invention.

FIG. 5 and FIG. 6 illustrate a rescuing and carrying device in the third embodiment of the present invention. The rescuing and carrying device C of the embodiment comprises: a supporting portion 1, handhold belts 2, safety belts 3, a drag belt 4 and shoulder belts 5; wherein the handhold belts 2, the safety belts 3, the drag belt 4 and the shoulder belts 5 are fixed to the supporting portion 1.

The structure of the supporting portion 1 is the same as that of the second embodiment.

The structures of the handhold belts 2 are the same as those of the second embodiment.

Here, the safety belts 3 comprise two shoulder safety belts 31, a waist safety belt 33 and a leg safety belt 34'; and there are adjusting members placed on the safety belts 3 to adjust the length thereof depending on the need. The upper ends of the two shoulder belts 31 are respectively fixed on the top border of the supporting portion 1, and the lower ends are fixed on some part under the waist belt 33. The waist safety belt 33 is divided into two segments, one end of which is respectively fixed on the both side borders of the supporting portion 1, and on the other end of which is placed a buckle for buckling them together. There are two leg safety belts 34', with each fixed on the waist safety belt 33.

There is one drag belt 4, and it is placed on the top border of the supporting portion 1, with the two ends of the belts fixed on the ends of the top border.

The shoulder belts 5 are the same as those of the second embodiment.

The rescuing and carrying device of the embodiment also includes a protection cover 6', the width is equal to or somewhat larger than that of the supporting portion 1, and the length is substantially equal to that of a leg of a body. The bottom border of the protection cover 6' is connected to that of the supporting portion, and the two side borders of the protection cover 6' are ruffled and connected to those adjacent to the bottom border of the supporting portion 1, thereby a close protection sheath which has an opening and occupies certain room is formed.

The length of the protection cover 6' can be adjusted according to the specific part of human body. For example, if other parts of body except for the head need to be protected fully, the length of the protection cover 6' can be designed to be somewhat larger than that of body from the shoulder to the foot.

The above components are made of flexible materials with some tenacity.

When using the device, unbuckle the shoulder safety belt 31 and waist safety belt 32 first, and put the sick horizontally on the supporting portion 1, with the legs inside the protection sheath; and then, buckle the shoulder safety belt 31 and the waist safety belt 32 for fix the sick on the supporting portion stably. After that, carriers can put the shoulder belts on their back and hold the handhold belts 3 depending on how the sick needs to be carried. If the sick needs to be carried lying down, the shoulder belts 5 are not used, and only the drag belt 4 and the handhold belts 2 are used for carrying. Where there are not enough carriers in an emergency, the drag belts 4 can also be used by one carrier to carry. The sick can also sit outside the protection sheath with the legs out, and then the shoulder safety belt 31, waist safety belt 32 and leg safety belt 34' are fastened for carrying.

The rescuing and carrying device C according to the embodiment has the following advantages besides those of the first embodiment:

1. With the structure being different from that of the first embodiment, the leg safety belt can fix the sitting position of the sick to prevent the two legs from swinging, thus enhancing stability.

2. With the protection sheath for the body, specific parts of the sick can be protected and body heat loss can be prevented.

3. With the special structure of the embodiment, the leg safety belt can fix the sitting position of the sick to prevent the two legs from swinging, thus the stability is enhanced. Unnecessary injury to the sick can be avoided.

4. With the rescuing and carrying device, the respiration valve of the sick can be opened naturally for breathing freely, because the head is raised backward when he/she is carried. It complies with the requirement for rescuing.

The fourth embodiment of the invention will be described.

Figure 7:
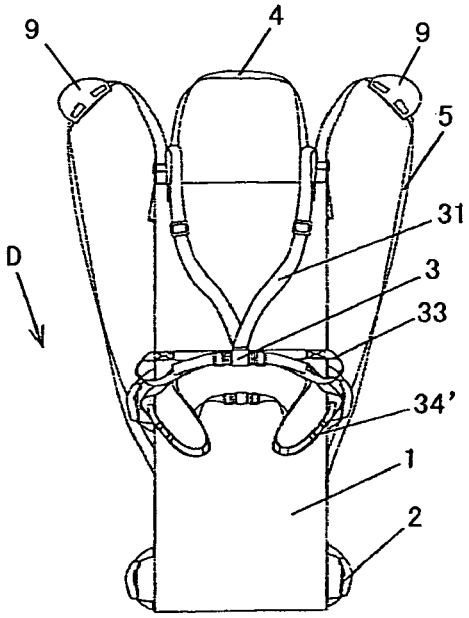
FIG. 7 is a front view illustrating a rescuing and carrying device in accordance with the fourth embodiment of the present invention.
Figure 8:
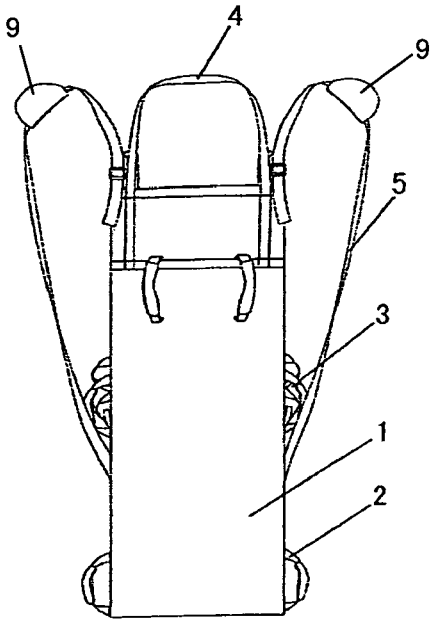
FIG. 8 is a back view illustrating a rescuing and carrying device in accordance with the fourth embodiment of the present invention.
Figure 9:
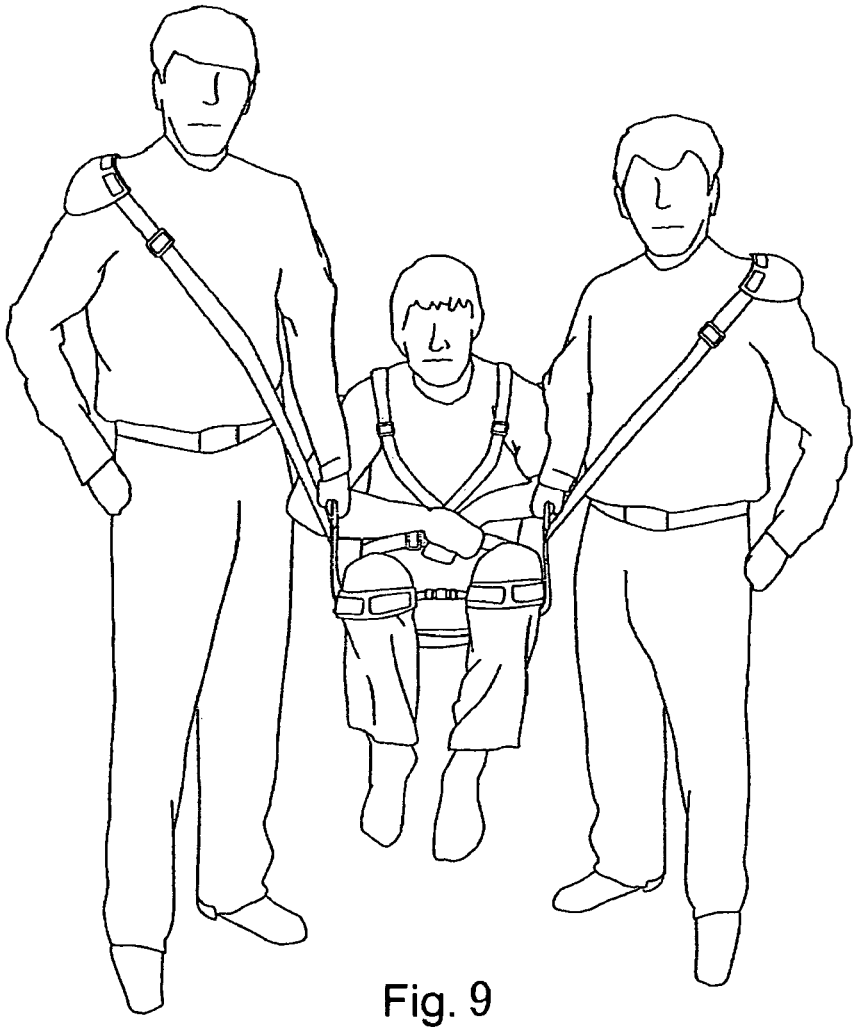
FIG. 9 is a state diagram illustrating a rescuing and carrying device in use in accordance with the fourth embodiment of the present invention.

FIG. 7, FIG. 8 and FIG. 9 illustrate a rescuing and carrying device in accordance with the fourth embodiment of the present invention. The rescuing and carrying device D of the embodiment comprises: supporting portion 1, handhold belts 2, safety belts 3, a drag belt 4 and shoulder belts 5; wherein the handhold belts 2, the safety belts 3, the drag belt 4 and the shoulder belts 5 are fixed on the supporting portion 1.

The supporting portion 1 has a rectangle shape, the length is equal to that of body from the head to the foot, and the width is somewhat larger than that of the human back.

Here, there is one pair of handhold belts 2, which are fixed respectively on the lower part of the two side borders of the supporting portion 1. Arranged on the handhold belts 2 are slidable hand liners.

The safety belts 3 comprise two shoulder safety belts 31, a waist safety belt 33 and a leg safety belt 34', on which adjusting members are arranged for adjusting the length of the belts depending on the need. The shoulder safety belt 31 and waist safety belt 33 are buckled at the waist of the sick to fasten the upper body of the sick stably on the supporting portion 1; the leg safety belts 34' are used to fix the sitting position of the sick.

There is one drag belt 4, and it is placed on the top border of the supporting portion 1, with two ends fixed on the ends of the border.

Two shoulder belts 5 are set on the two side borders of the supporting portion 1 respectively, the upper end is fixed where the upper end of the side border and the top border meet, and the lower end below the midpoint of the side border.

Moreover, the length adjusting members and the slidable shoulder gaskets 9 are arranged on the shoulder belts 5.

Each of the above components is made of flexible materials that have certain tenacity.

When using the device, unbuckle the safety belt 3 and let the sick lie or sit on the supporting portion 1; then buckle all the safety belts 3 to secure the sick stably on the supporting portion 1; two carriers then put the shoulder belts 5 on their shoulder to carry the sick. Alternatively, two or more carriers can use the handhold belts 2 and/or drag belts 4. Where there are not enough carriers, the drag belts 4 can also be used by one carrier to carry.

The rescuing and carrying device D according to the embodiment further has the following advantages:

1. Because the device has shoulder belts, the carrier can carry the belts on the shoulders and simultaneously the arms can lift the handhold belts. In this way, it can significantly reduce the possibility of hurting the carriers' waists, backbones, and hands, which can result from operating the device using only the hands. This also frees the carriers' hands to deal with other emergency events. Using the structure, it is very convenient to carry unconscious sick, and it allows the device to be balanced by the carrier by avoiding the imbalance due to the weight of the unconscious body. The shoulder gasket can enhance the comfort of carrying and decrease the possibility of hurting the back. Moreover, the length adjustable member on the shoulder belt can be adjusted to make the length match the height of the sick, or it can be adjusted freely even during carrying without offloading the sick. This eliminates unnecessary injury to them and gets them to the ambulance as soon as possible.

2. With the special structure in the embodiment, the leg safety belt can fix the sitting position of the sick to prevent the unnecessary strain on the back resulting from excessive body swaying. It can increase the stability of the sitting position when the sick is carried and prevent any unnecessary injury to him/her.

3. With the handhold belt, the carriers can stabilize the device to prevent any swaying during carrying when they put the shoulder belts on their back.

4. With the drag belt, when there are not enough carriers during an emergency, the drag belt can also be used by one carrier to carry.

5. With the special design of the rescuing and carrying device, the respiration valve of the sick can be opened naturally for breathing freely, because the head is raised backwards when he/she is carried. It complies with the requirement for rescuing.

Figure 12:
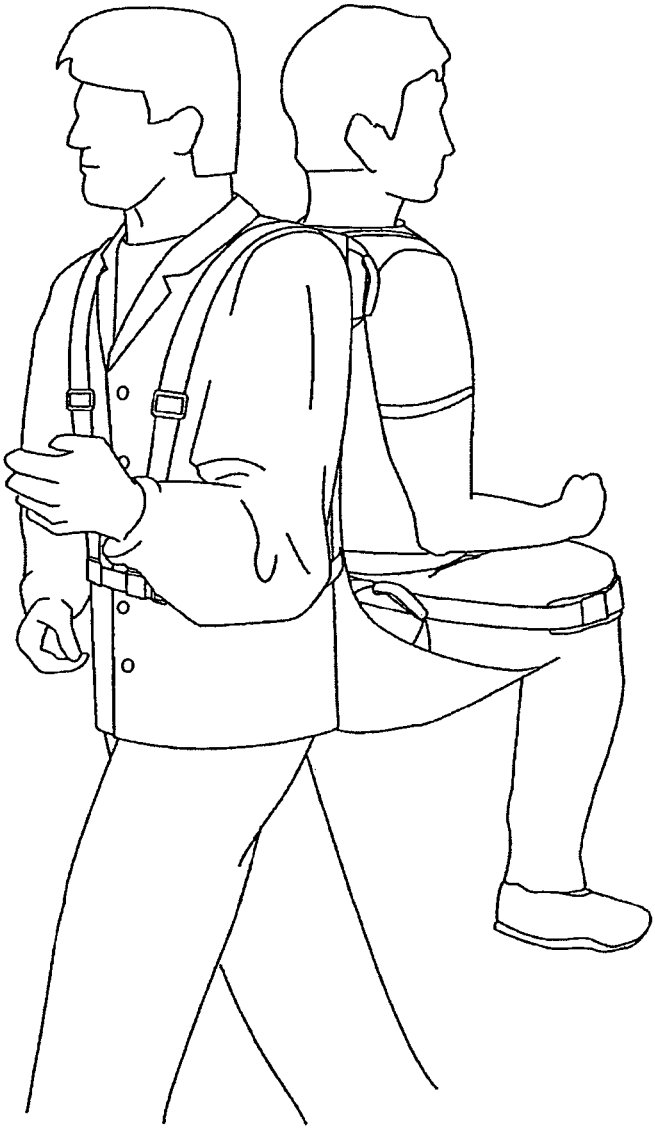
FIG. 12 is a state diagram illustrating a rescuing and carrying device in use in accordance with the fifth embodiment of the present invention.
Figure 10:
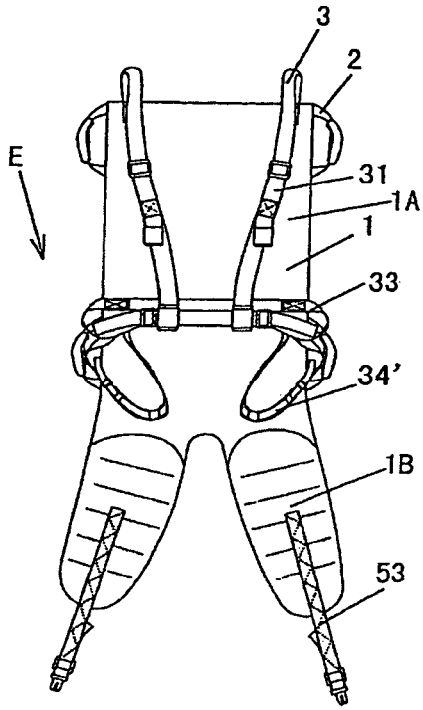
FIG. 10 is a front view illustrating a rescuing and carrying device in accordance with the fifth embodiment of the present invention.
Figure 11:
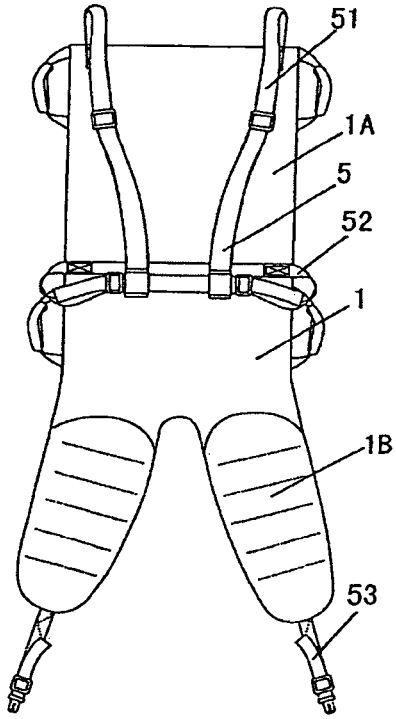
FIG. 11 is a back view illustrating a rescuing and carrying device in accordance with the fifth embodiment of the present invention.

FIG. 10, FIG. 11 and FIG. 12 illustrate a rescuing and carrying device of the fifth embodiment of the invention. The rescuing and carrying device E of the embodiment comprises: supporting portion 1, handhold belts 2, safety belts 3 and shoulder belts 5; wherein the handhold belts 2, the safety belts 3 and the shoulder belts 5 are fixed on the supporting portion 1.

The length of the supporting portion 1 is almost equal to distance from head to foot and the width is almost equal to the width of the human back. The supporting portion 1 has a shape matching that of the back and leg of a human body. The supporting portion 1 further comprises a back supporting portion IA and a leg supporting portion IB. On the leg supporting portion IB, there are leg fastener belts 53 made of flexible materials, the end has a buckle for connecting to the waist safety belt 33.

There are two pairs of handhold belts 2 fixed in pairs on the upper and middle part of the two side borders of the supporting portion 1.

The safety belts 3 comprise shoulder safety belts 31, a waist safety belt 33 and a leg safety belt 34'. One end of the shoulder safety belt 31 is fixed on the top border of the supporting portion 1, and the other end is connected to the waist safety belt 33, in which the position of the joint can be adjusted. There are two leg safety belts 34', with each fixed on the waist safety belt 33. And, on all the safety belts, there are adjusting members set for adjusting the length.

The shoulder belts 5 comprise shoulder fastener belts 51 and a waist fastener belt 52, which are fixed on the back of the supporting portion 1. One end of the shoulder fastener belt 51 is fixed on the top border of the supporting portion 1, and the other end is connected to the waist fastener belt 52. There are adjusting members set on the shoulder fastener belts 51 and the waist fastener belt 52 to adjust the length. In addition, the waist fastener belt 52 is divided into two segments, one end of which is respectively fixed on the side border of the supporting portion 1. On the belts there are buckles which can be unbuckled or buckled.

Each of the above components is made of flexible materials that have certain tenacity. When using the device, unbuckle the safety belt 3 and adjust its length to adapt to the body; then put the supporting portion 1 on the back of the sick and fasten the waist safety belt 33; let the shoulder safety belts go around the shoulder and be fixed on the waist safety belt 33; then open the shoulder fastener belt 51 and waist fastener belt 52, the carriers and the sick stand back to back, and the shoulder being fixed by the shoulder fastener belt 51. After the waist fastener belt 52 is fastened, the leg fastener belt 53 is put on the legs of the sick and the leg safety belt 34' is used to fix the sitting position of the sick by adjusting the position of the adjusting members.

By using such a device, carriers can put the sick on their back to free their hands to deal with any emergency. At the same time, the sick on the back of the carriers can watch the situation behind them, and have free hands to deal with any emergency situation. This device is especially suitable for carrying those partially wounded, but with functioning hands.

The sixth embodiment of the invention will be described as follows.

Figure 14:
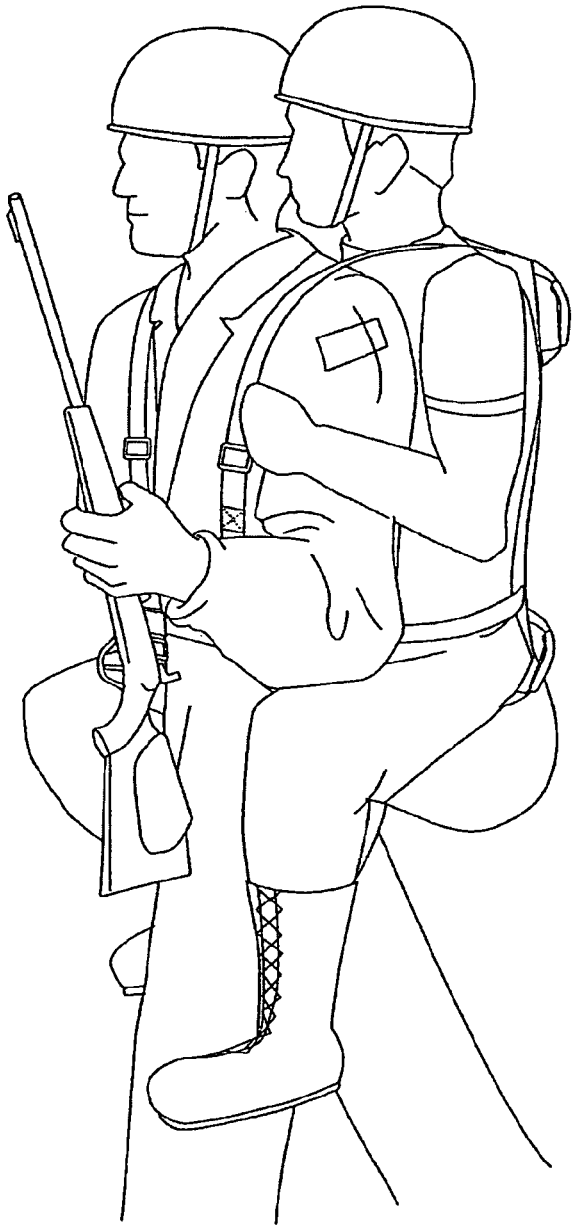
FIG. 14 is a state diagram illustrating a rescuing and carrying device in use in accordance with the sixth embodiment of the present invention.
Figure 13:
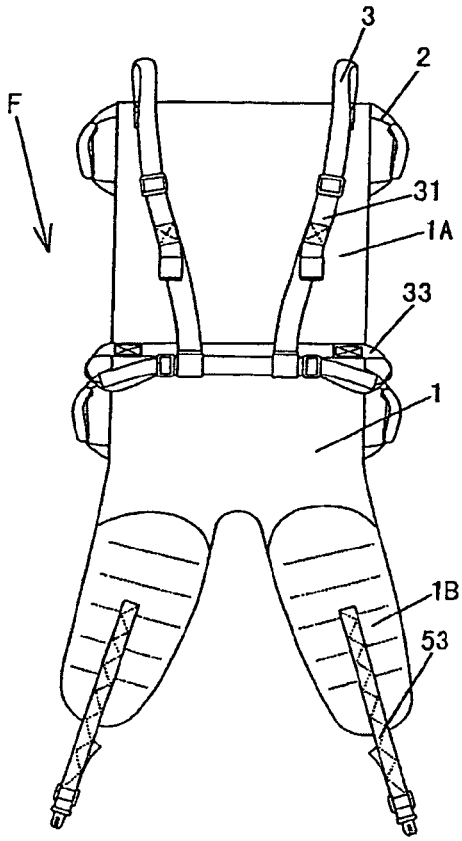
FIG. 13 is a front view illustrating a rescuing and carrying device in accordance with the sixth embodiment of the present invention.

FIG. 13 and FIG. 14 illustrate a rescuing and carrying device in accordance with the sixth embodiment of the present invention. The rescuing and carrying device F of the embodiment comprises: a supporting portion 1, handhold belts 2, safety belts 3 and shoulder belts 5, wherein the handhold belts 2, the safety belts 3 and the shoulder belts 5 are fixed on the supporting portion 1.

The structure of the supporting portion 1 is the same as that of the fifth embodiment.

The structure of the handhold belts 2 is the same as that of the fifth embodiment. The safety belts 3 comprise shoulder safety belts 31 and a waist safety belt 33. One end of the shoulder safety belts 31 is fixed to the top border of the supporting portion 1 and the other end is connected to the waist safety belt 33, in which the position of the joint can be adjusted. And, on all the safety belts, there are adjusting members set for adjusting length thereof.

In the embodiment, the shoulder safety belts 31 correspond to the shoulder fastener belts 51 in the shoulder belts 5 and the waist safety belt 33 corresponds to the waist fastener belt 52 in the shoulder belts 5.

Each of the above components is made of flexible materials that have certain tenacity.

When using the device, unbuckle the safety belts 3 first, and adjust the length thereof to make sure the belt can bind the sick; then, put the supporting portion 1 on the back of the sick and let the sick crawl onto the carrier's back, and buckle the waist safety belt 33 to bind the sick and the carrier together; subsequently, fix the shoulder safety belt 31 to the waist safety belt 33 at the waist of the carrier by making the shoulder safety belt 31 cross the shoulders of the sick and the carriers; after that, pull the leg fastener belt 53 up to be buckled to the waist safety belt 33, and raise the legs of the sick to carry him/her on the back of the carrier.

Using the rescuing and carrying device F, assures that the carriers can carry the sick on their backs stably, while their hands are free to deal with any emergency situation, thus the device is especially suitable for use in battle.

The invention claimed is:

1. A rescuing and carrying device, comprising:

a supporting portion (1) having a shape of a sheet or a bag, made of flexible materials;

a pair of shoulder belts (5) made of flexible materials and sized to facilitate hands free support by two carriers such that one carrier stands on each side of the supporting portion, each shoulder belt positioned on a respective side of the supporting portion and having a length extending continuously from a respective side of the supporting portion to cross a torso and lay over a distal shoulder of the carrier standing next to the respective shoulder belt, each shoulder belt having a first end and a second end, the first end and the second end fixed on an extending directly from a respective border edge of said supporting portion (1) such that each shoulder belt is configured to be worn by the two carriers to balance the device, wherein for each shoulder belt (5), the first end is fixed on a longest linear edge of a top border of said supporting portion (1), and the second end is fixed at a point below a midpoint of the respective border edge of said supporting portion (1) and extending from an edge of the respective side border, the edge of the side border from which the second end extends is perpendicular in direction to the linear edge of the top border from which the first end extends, wherein the point below the midpoint away from the to border is closer to the midpoint than to a bottom edge of the supporting portion, wherein each shoulder belt is made of a same and single-flexible material throughout the belt extending from each respective border edge of the supporting portion;

at least one pair of handhold belts (2) made of flexible materials, each handhold belt of the at least one pair of handhold belts being fixed on a side border of said supporting portion (1), and each of the at least one pair of handhold belts spaced a certain distance from the other; and a plurality of safety belts (3) made of flexible materials, the plurality of safety belts are fixed on said supporting portion (1), and wherein at least one of the plurality of safety belts is fixed between the first end and the second end of each shoulder belt.

2. The rescuing and carrying device according to claim 1, further including at least one drag belt (4) made of flexible materials fixed on said supporting portion (1), in which, two ends thereof are fixed on a top border or a bottom border of said supporting portion (1).

3. The rescuing and carrying device according to claim 1, further including a hand liner, the position of which is adjustable, and placed on said handhold belt (2).

4. The rescuing and carrying device according to claim 1, wherein said plurality of safety belts comprise: a plurality of shoulder safety belts (31) and a waist safety belt (33), in which one end of each of said plurality of shoulder safety belts (31) is fixed on said supporting portion (1) and a second end of each of said plurality of shoulder safety belts is connected to said waist safety belt (33) with a connection position between each second end and the waist safety belt being adjustable.

5. The rescuing and carrying device according to claim 4, wherein said plurality of safety belts further includes a chest safety belt (32) which is in parallel with said waist safety belt (33) and rests across said shoulder belts (31).

6. The rescuing and carrying device according to claim 4, characterized in that, said safety belts further includes two leg safety belts (34) fixed on said waist safety belt (33) respectively, and connection belts are optionally placed between said leg safety belts (34).

7. The rescuing and carrying device according to claim 1, further comprising a pair of shoulder gaskets, the position of which can be adjusted, and arranged on said shoulder belts (5).

8. The rescuing and carrying device according to claim 1, wherein a length adjustable member is arranged on said pair of shoulder belts (5).

9. The rescuing and carrying device according to claim 1, wherein said supporting portion (1) is in a shape of a rectangle.

10. A rescuing and carrying device, comprising:

a supporting portion (1) having a shape of a sheet or a bag, made of flexible materials;

a pair of shoulder belts (5) made of flexible materials and sized to facilitate hands free support by two carriers such that one carrier stands on each side of the supporting portion, each shoulder belt positioned on a respective side of the supporting portion and having a length extending continuously from a respective side of the supporting portion to cross a torso and lay over a distal shoulder of the carrier standing next to the respective shoulder belt, each shoulder belt having a first end and a second end, the first end and the second end fixed on and extending directly from said supporting portion (1) such that each shoulder belt is configured to be worn by the two carriers to balance the device; wherein for each shoulder belt (5), the first end is fixed on a longest linear edge of a top border of said supporting portion (1), and the second end is fixed at a point below a midpoint of the side border of said supporting portion (1) extending from an edge of the side border, the edge of the side border from which the second end extends is perpendicular in direction to the linear edge of the top border from which the first end extends, wherein the point below the midpoint away from the top border is closer to the midpoint than to a bottom edge of the supporting portion;

at least one pair of handhold belts (2) made of flexible materials, each handhold belt of the at least one pair of handhold belts being fixed on a side border of said supporting portion (1), and each of the at least one pair of handhold belts spaced a certain distance from the other; and a plurality of safety belts (3) made of flexible materials, the plurality of safety belts are fixed on said supporting portion (1).

* * * * *